US008829811B2

(12) United States Patent
Godbole et al.

(10) Patent No.: US 8,829,811 B2
(45) Date of Patent: Sep. 9, 2014

(54) COMPENSATION METHOD AND CIRCUIT FOR LINE REJECTION ENHANCEMENT

(75) Inventors: Kedar Godbole, San Jose, CA (US); Hariom Rai, Milpitas, CA (US)

(73) Assignee: Cypress Semiconductor Corporation, San Jose, CA (US)

( * ) Notice: Subject to any disclaimer, the term of this patent is extended or adjusted under 35 U.S.C. 154(b) by 403 days.

(21) Appl. No.: 12/273,322

(22) Filed: Nov. 18, 2008

(65) Prior Publication Data

US 2010/0123411 A1 May 20, 2010

(51) Int. Cl.
*H05B 37/02* (2006.01)
*H05B 33/08* (2006.01)

(52) U.S. Cl.
CPC ..... *H05B 33/0815* (2013.01); *H05B 33/0851* (2013.01)
USPC ..... 315/307; 315/308; 315/247

(58) Field of Classification Search
CPC ..... H05B 33/0815; H05B 33/0845; H05B 33/0875; H05B 33/0884; H05B 33/0887
USPC ..... 315/291–311, 185 S, 312–326, 247, 315/129, 149, 150; 323/319, 344–345, 351, 323/259, 235
See application file for complete search history.

(56) References Cited

U.S. PATENT DOCUMENTS

| | | | | |
|---|---|---|---|---|
| 7,511,436 | B2 * | 3/2009 | Xu | 315/307 |
| 8,125,805 | B1 * | 2/2012 | Melanson | 363/89 |
| 2002/0030455 | A1 * | 3/2002 | Ghanem | 315/291 |
| 2007/0188114 | A1 * | 8/2007 | Lys et al. | 315/308 |
| 2007/0279820 | A1 * | 12/2007 | Fang et al. | 361/97 |
| 2009/0079355 | A1 * | 3/2009 | Zhou et al. | 315/246 |
| 2010/0265064 | A1 * | 10/2010 | Mayer et al. | 340/541 |

FOREIGN PATENT DOCUMENTS

CN 1784930 A 6/2006

OTHER PUBLICATIONS

Chinese Office Action for International Application No. 200910174428.7 dated Apr. 11, 2014; 3 pages.
Chinese Office Action for International Application No. 200910174428.7 dated Jul. 26, 2013; 4 pages.

* cited by examiner

*Primary Examiner* — Douglas W Owens
*Assistant Examiner* — Henry Luong

(57) ABSTRACT

An embodiment of the present invention is directed to a method and circuit to control light emitting diode (LED) output. The method includes receiving a line voltage signal which powers a lighting circuit comprising an LED and determining an adjustment of a threshold based on a variation of the line voltage signal and/or a controller delay or other practical controller limitation or imperfection. The method further includes dynamically adjusting a threshold or other reference of a controller which controls a switch of said lighting circuit for compensating for line variations to maintain a substantially uniform LED current.

17 Claims, 5 Drawing Sheets

COMPENSATION METHOD AND CIRCUIT FOR LINE REJECTION ENHANCEMENT

TECHNICAL FIELD

Embodiments of the present invention generally relate to light emitting diode driver circuit control.

BACKGROUND

Light emitting diodes (LEDs) are increasingly used for lighting applications including home and office lighting fixtures. LEDs are current fed devices and as such control of the current allows modulation of the output light intensity. Further, LEDs have a relatively small time constant meaning that certain variations in current will quickly impact the output light intensity. Such low frequency variations may manifest as a flicker which often is unpleasant to the human eye.

Conventional LED circuits have included a power source and a resistor in addition to the LED. Unfortunately with these supply types, a large fraction of the power is dissipated in the resistor and therefore the circuit is not efficient. As LEDs increase in power output and increase in current requirements, the power dissipated in the resistor increases, thus more power is wasted.

SUMMARY OF THE INVENTION

An embodiment of the present invention is directed to a method for controlling light emitting diode (LED) output. The method includes monitoring a line voltage signal which powers a lighting circuit comprising one or more LEDs and determining an adjustment of a threshold within that lighting circuit based on a variation of the line voltage signal. The method further includes dynamically adjusting the threshold of a controller circuit (e.g., hysteretic controller, peak current controller, and the like) which controls a switch that comprises the switch mode power converter (e.g., hysteretic controller, peak current controller, and the like) powering the lighting circuit. The threshold functions to control the current in the LED lighting circuit. The determined adjustment of the threshold is apportioned so as to cancel out or substantially reduce variations and effects of time delays or other practical imperfections associated with the controller. The method may include scaling and filtering the line voltage signal to remove noise and isolate components of interest (e.g., frequencies below 120 Hz). The method is effective at reducing unwanted low frequency flicker for the LED output.

DETAILED DESCRIPTION

Reference will now be made in detail to embodiments of the claimed subject matter, examples of which are illustrated in the accompanying drawings. While the invention will be described in conjunction with embodiments, it will be understood that they are not intended to limit the claimed subject matter to these embodiments. On the contrary, the claimed subject matter is intended to cover alternatives, modifications and equivalents, which may be included within the spirit and scope of the claimed subject matter as defined by the claims. Furthermore, in the detailed description of the present invention, numerous specific details are set forth in order to provide a thorough understanding of the claimed subject matter. However, it will be obvious to one of ordinary skill in the art that the claimed subject matter may be practiced without these specific details. In other instances, well known methods, procedures, components, and circuits have not been described in detail as not to unnecessarily obscure aspects of the claimed subject matter.

Example Systems

FIGS. 1-3*b* illustrate example components used by various embodiments of the present invention. Although specific components are disclosed in circuits 100, 200, 300, and 350 it should be appreciated that such components are examples. That is, embodiments of the present invention are well suited to having various other components or variations of the components recited in systems 100, 200, 300, and 350. It is appreciated that the components in systems 100, 200, 300, and 350 may operate with other components than those presented, and that not all of the components of systems 100, 200, 300, and 350 may be used to achieve the goals of systems 100, 200, 300, and 350.

Further, systems 100, 200, 300, and 350 include components or modules that, in various embodiments, are carried out by software, e.g., a processor under the control of computer-readable and computer-executable instructions. The computer-readable and computer-executable instructions reside, for example, in data storage features such as computer usable memory, removable storage, and/or non-removable storage. The computer-readable and computer-executable instructions are used to control or operate in conjunction with, for example, a processing unit. It should be appreciated that the aforementioned components of systems 100, 200, 300, and 350 can be implemented in hardware or software or in a combination of both.

Figure 1:
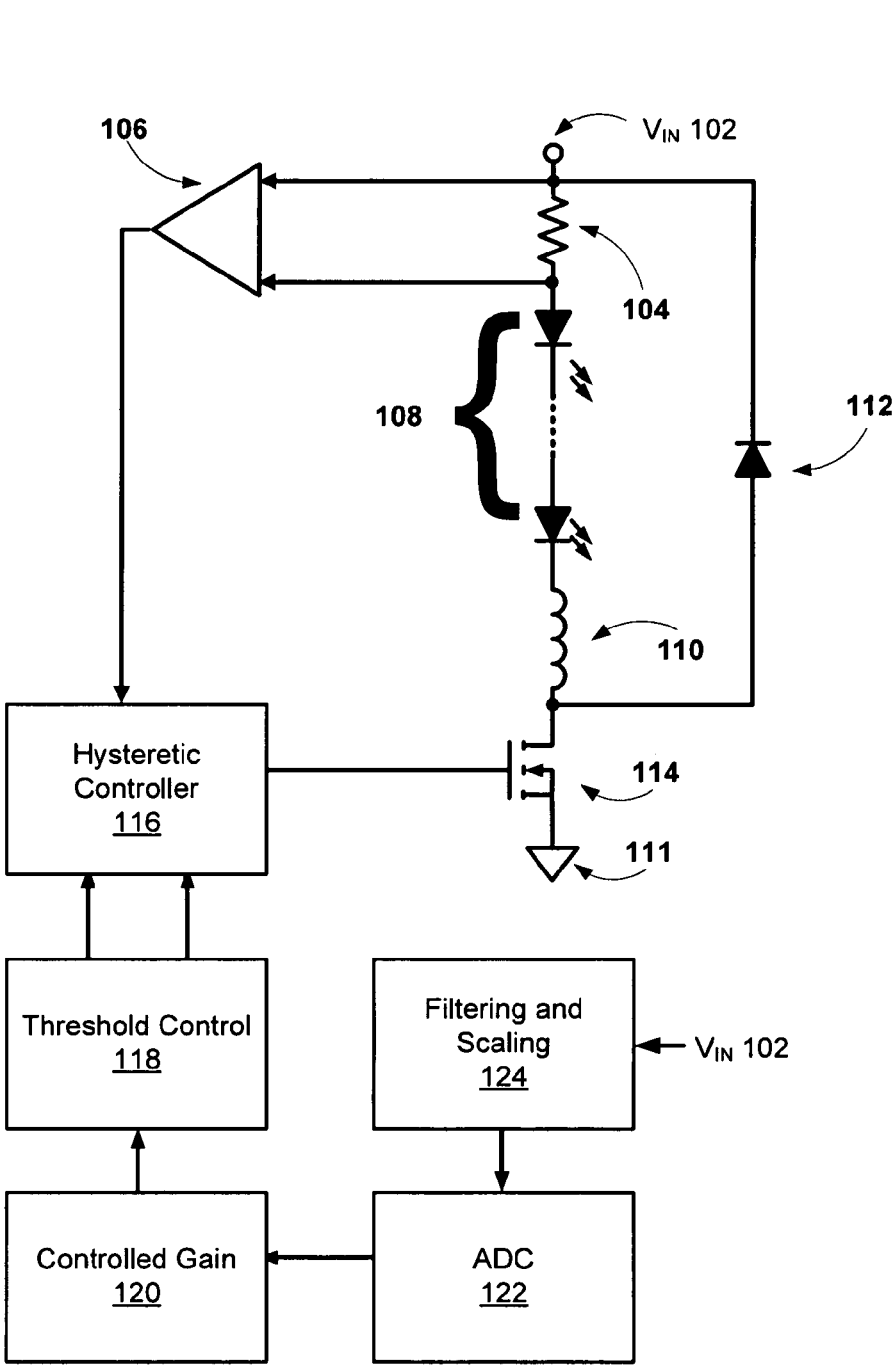
FIG. 1 shows block diagram of an exemplary circuit system for compensating for a power line variation, in accordance with one embodiment of the present invention.

FIG. 1 shows block diagram of an exemplary system for compensating for a power line variation, in accordance with one embodiment of the present invention. System 100 includes a node for receiving a power line voltage ($V_{in}$) 102, sense resistor 104, sense amplifier 106, N series of light emitting diodes (LEDs) 108, inductor 110, diode 112, switch 114, ground 111, hysteretic controller 116, threshold control 118, controlled gain 120, analog to digital converter (ADC) 122, and filtering and scaling module 124. It is appreciated that embodiments of the present invention may compensate for a variety of power line voltage variations including, but not limited to, periodic variations (e.g., sine waves), ripples, spikes, drops. It is further appreciated that the components of system 100 may operate in a closed loop to provide current control.

Line voltage ($V_{in}$) node 102 provides power to allow N series of LEDs 108 to output light. Line voltage 102 may be from a power supply including an AC plug, a transformer, bridge rectifier, and a filter. Line voltage 102 may vary for a variety of reasons including, but not limited to, source power fluctuations (e.g., power spikes or power drops). Further, the filter size determines what power variations enter into system 100 and impact the current through N series of LEDs 108. For example, there may be a low frequency ripple at 60 Hz or 120 Hz depending on the rectifier structure. Thus, a component of the 60 Hz or 120 Hz ripple may make its way into the current that is flowing through the LEDs (by affecting the trip points of switch 114) and affect light output. Such lower frequency variations (e.g., 20 Hz and frequencies below 120 Hz) may be visible by the eye and appear as an unpleasant flicker. Embodiments of the present invention, described herein, compensate for this unwanted flicker.

Sense resistor 104 in combination with sense amplifier 106 function to measure the current flowing though N series of LEDs 108. In one embodiment, sense amplifier 106 is a current sense amplifier which provides an amplified differential current reading to hysteretic controller 116.

Inductor 110 facilitates a linear change in current through N series of LEDs 108. When switch 114 is turned off, inductor 110 by its nature according to L di/dt facilitates maintenance of the current in the circuit (e.g., by release of its stored magnetic energy). That is, inductor 110 generates voltage as switch 114 turns off. Diode 112 allows a path for current to flow to the LEDs 108 when switch 114 is turned off.

The linear nature of inductor 110 allows the current to be ramped up and ramped down between an upper threshold ($I_{peak}$) and a lower threshold ($I_{valley}$) with the aim to maintain an average current ($I_{average}$) via rapid switching of switch 114. Switch 114 may be implemented using a variety of switching elements including, but not limited to, a metal-oxide-semiconductor field-effect transistor (MOSFET), a bipolar junction transistor (BJT), or a thyristor.

Hysteretic controller 116 is operable to control switch 114 at intended trip points for controlling the current through N series LEDs 108. Switch 114 is modulated for instance by a temporal density function of hysteretic controller 116. It is appreciated that hysteretic controller 116 may be any other controller operable to generate a temporal density function to drive switch 114 or modulate the current flowing through N series of LEDs 108 by any suitable modulation function.

Hysteretic controller 116 controls the current in the circuit based on the current (e.g., measured via sense amplifier 106) in relation to an upper threshold ($I_{peak}$) and a lower threshold ($I_{valley}$). When the upper threshold ($I_{peak}$) is reached, hysteretic controller turns off switch 114. This causes the current to ramp down as the current flows through diode 112 powered by inductor 110. When the current reaches the lower threshold ($I_{valley}$), switch 114 is turned on and the current ramps up again. It is appreciated that the references for thresholds of hysteretic controller 116 can either be internal or external. The thresholds of hysteretic controller 116 are controlled by controller 118 and may be programmable by software based programmed digital to analog converts (DACs) or analog inputs. Further, hysteretic controller 116 may support a dimming function based on a density function (e.g., Delta-Sigma or Stochastic Signal Density Modulation (SSDM)).

Hysteric controller 116 may utilize comparators for determining whether the current has reached the upper or lower threshold. The comparators have a finite (non-zero) delay which results in a delay of hysteretic controller 116 in responding to the current flowing through N series of LEDs 108. During this delay time, the voltage and current continues to ramp until switch 114 activates. When the upper threshold is reached, the delay time of hysteretic controller 116 causes the current through the LEDs to exceed the upper threshold resulting in a current overshoot. The overshoot current may be governed by the equation:

$$\text{Overshoot} = \frac{(V_{in} - V_{LED})}{L} \cdot T_{Delay}$$

The overshoot is dependent on magnitude line voltage 102 or $V_{in}$, which can influence the LED current and brightness. Accordingly, the amount of the overshoot corresponds to how quickly the current ramp climbs which is based on the variation, change, or increase in line voltage 102.

Similarly, the delay of hysteretic controller 116 may result in undershoot where the current drops below the lower threshold. Undershoot may be governed by the equation:

$$\text{Undershoot} = \frac{-V_{LED}}{L} \cdot T_{Delay}$$

It is appreciated that the undershoot may be caused by the delay of hysteretic controller 116 and generally is independent of variations in line voltage 102 or $V_{in}$.

The overshoot and undershoot thus effect the average current through the LEDs and thereby the light output by N series of LEDs 108. The average current may be governed by the equation:

$$I_{average} = \frac{I_{peak} + I_{valley}}{2}$$

Where $I_{peak}$ is the actual peak of the current caused by overshoot and $I_{valley}$ is the actual current of the LED including undershoot. Thus, as the average current fluctuates, based on the delay of hysteretic controller 116 and variations in line voltage 102, so does the brightness of N series of LEDs 108. It is appreciated that switch 114 is operated at such high frequencies that its normal operation does not cause any noticeable flicker from the LEDs 108. However, low frequency power line variations may affect the overshoot current in such a way as to be visible to the eye, e.g., 60 Hz or below, for instance. Dynamic threshold control circuit 118 compensates for these low frequency power line variations.

Filtering and scaling system 124 removes noise from line voltage 120. Filtering and scaling system 124 may further separate certain components (e.g., ripples in line voltage 102) and isolate components of interest. For example, filtering and scaling system 124 may isolate and respond to only certain frequencies which are of interest (e.g., ripples and variations below 120 Hz). Filtering and scaling system 124 thus removes noise and other variations in line voltage 102 thereby enabling system 100 to respond appropriately to variations in line voltage 102. It is appreciated that filtering and scaling system 124 may be optional and may facilitate increasingly precise current control. It is further appreciated that in other embodiments line voltage signal 120 may be scaled or digitally filtered.

Analog to digital converter (ADC) 122 digitally samples the analog power source signal or line voltage 102. ADC 122 outputs the digital value of the line voltage to controlled gain circuit 120. It is appreciated that ADC is coupled to line voltage 120.

Controlled gain module 120 determines a compensation for a power variation in line voltage 120. The compensation determined by controlled gain module is used by threshold control circuit 118 to dynamically adjust the threshold of hysteretic controller 116. In one embodiment, controlled gain module 120 may perform an inversion of the line voltage value and determine a factor for the threshold to be multiplied by to compensate for the variation in line voltage 102. The compensation may be determined based on a variety of techniques including, but not limited to, polynomials, lookup tables, which may be in firmware or software. For example, line voltage 120 may have a 0.1 volt (V) amplitude sine-wave-based variation on a 1 V signal and controlled gain 120 may sample line voltage 120 and remove the 1 V signal. Controlled gain 120 may invert the 0.1 V sine wave value and send the inverted value to threshold control 118.

In accordance with embodiments of the present invention, threshold control module 118 modifies the threshold of hysteretic controller 116 such that the modified threshold compensates for the sampled power line variations on line voltage 102 thereby removing the impact of low frequency variations on line voltage 102 on the LED current. By altering the threshold supplied to hysteretic controller 116, the trip point it sets for switch 114 is dynamically altered in response to the power line variations. Threshold control module 118 may include a threshold generation function to generate a compensated threshold, which substantially cancels out the effect of power variations in line voltage 102. The compensated threshold may then be applied to hysteretic controller 116. Referring to the above example, threshold module 118 receives the inverted 0.1 V sine variation or compensation value and applies (e.g., adds) the compensation value to the current threshold to determine a compensated threshold.

The compensated threshold may cause hysteretic controller 116 to turn switch 114 off/on earlier e.g., dynamically alter the trip point. For example, where the delay of hysteretic controller 116 and/or an increase in power from line voltage 102 would result in an overshoot of the upper current threshold, controlled gain module 120 and threshold control 118 set the upper threshold lower such that hysteretic controller 116 turns off switch 114 earlier such that current does not substantially exceed the original or intended current threshold. This is done dynamically. As another example, where the delay of hysteretic controller 116 would result in an undershoot of the lower current threshold, controlled gain module 120 and threshold control 118 may increase the lower threshold such that hysteretic controller 116 turns on switch 114 earlier such that the current does not go substantially lower than the original current threshold. The latter example is of course independent of power line variations since the inductor 110 is supplying the current. In both examples, system 100 facilitates maintaining the average current through N series of LEDs 108. Controlled gain 120 and threshold control 118 may be software implemented or controlled.

In one exemplary embodiment, $I_{peak}$ is 1.15 A, $I_{average}$ is at 1 A, $I_{valley}$ is 0.85 A. The incoming voltage may cause the current surge up to 1.2 A due to a power variation and controller delay. The threshold of a controller may then be dynamically adjusted so that the set point of a comparator (or reference the comparator) is set to 1.1 A. This results in the current overshooting to 1.15 A or the intended $I_{peak}$. The adjusted threshold thus compensates to keep the overshoot within $I_{peak}$ thereby maintaining the average current at $I_{average}$ even though line voltage 102 changes. It is appreciated that the overshoot may be substantially reduced based on the delay of controller 116. It is further appreciated that embodiments of the present invention may perform multiple threshold adjustments.

Figure 2:
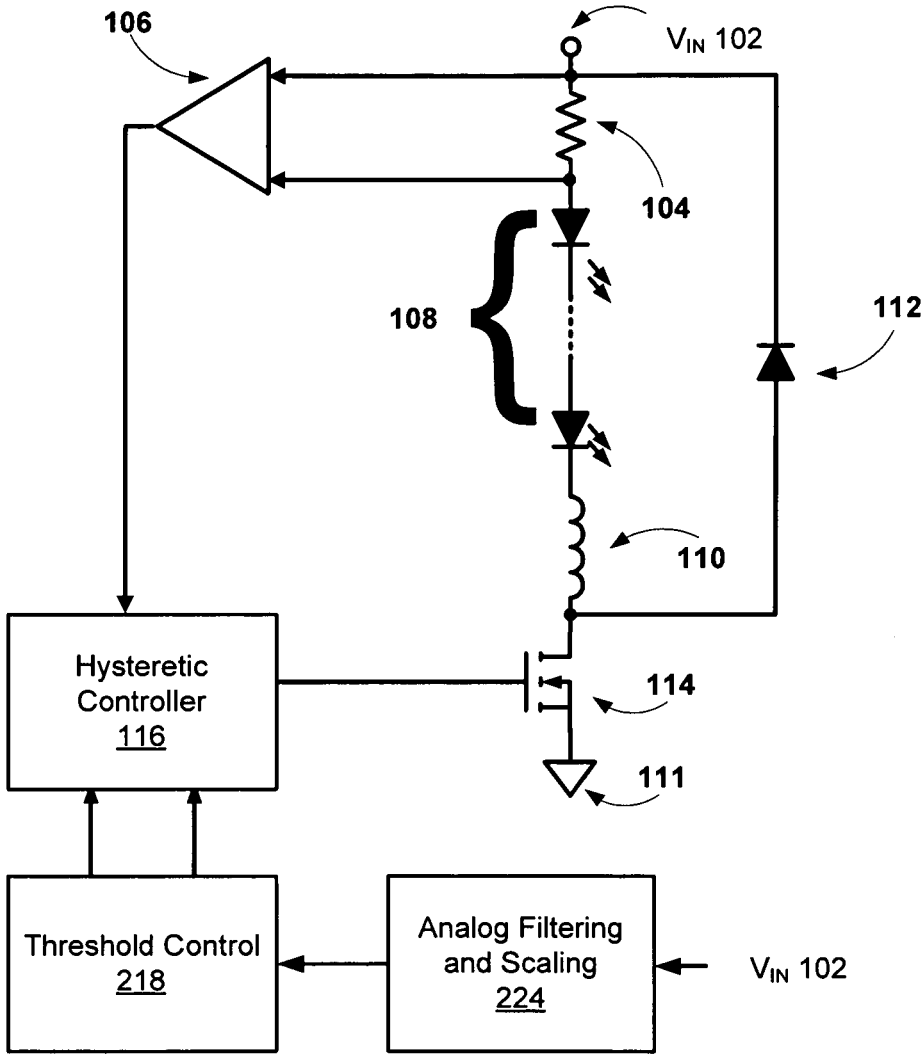
FIG. 2 shows block diagram of an exemplary circuit system for compensating for a power line variation, in accordance with another embodiment of the present invention.

FIG. 2 shows block diagram of another exemplary system for compensating for power line variation, in accordance with another embodiment of the present invention. System 200 includes a node for receiving a line voltage ($V_{in}$) 102, sense resistor 104, sense amplifier 106, N series of light emitting diodes (LEDs) 108, inductor 110, diode 112, switch 114, ground 111, hysteretic controller 116, threshold control 218, and analog filtering and scaling module 224.

System 200 operates in a substantially similar manner to system 100 except circuit 218 receives analog control signals. Analog filtering and scaling system 224 receives line voltage 102 and provides an analog signal to threshold control 218 which has noise removed and components of interest isolated. It is further appreciated that in other embodiments line voltage signal 120 may be scaled or analog filtered.

Threshold control 218 receives the analog filtered and scaled signal, and based on that signal, generates modified/compensated controller thresholds (e.g., inversed value, threshold scaling factor, or counteracting function). Threshold control 218 then applies compensated thresholds to hysteretic controller 116 to substantially maintain the average current ($I_{average}$) flowing through N series of LEDs 108 as described above.

Figure 3B:
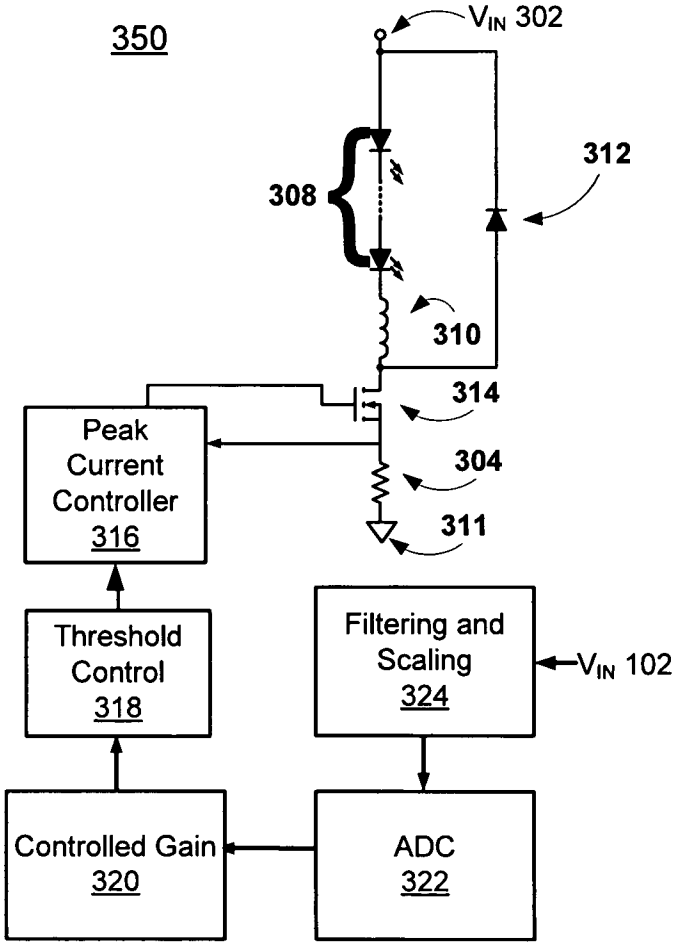
FIG. 3*b* shows block diagram of an exemplary system for compensating for a power circuit variation, in accordance with another embodiment of the present invention.
Figure 3A:
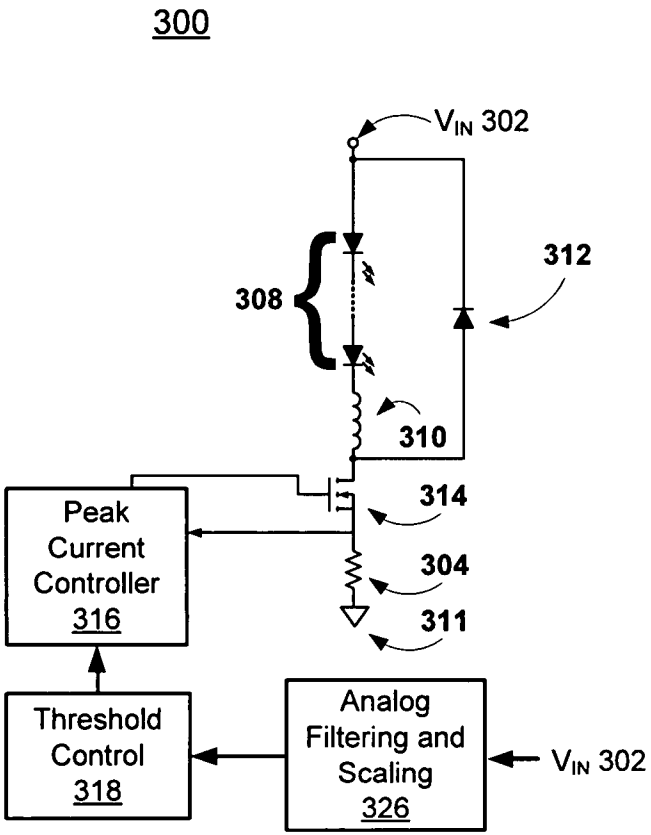
FIG. 3*a* shows block diagram of an exemplary system for compensating for a power circuit variation, in accordance with another embodiment of the present invention.

FIG. 3*a* shows block diagram of another exemplary system for compensating for a power variation, in accordance with another embodiment of the present invention. System 300 includes a node for receiving a line voltage ($V_{in}$) 302, sense resistor 304, N series of light emitting diodes (LEDs) 308, inductor 310, diode 312, switch 414, ground 311, peak current controller 316, threshold control 318, and analog filtering and scaling module 326.

Peak current controller 316 generates a pulse width modulated signal to control switch 314. Peak current controller 316 turns on switch 314 until the current flowing through N series of LEDs 308, as measured via sense resistor 304, reaches an upper threshold. Upon reaching the upper threshold, peak current controller 316 will turn off switch 314 and the current will ramp down. Peak current controller 316 after a predetermined time (e.g., at a fixed frequency) turns switch 314 on which causes the current to then ramp up again. The current will be allowed to ramp up until the upper threshold is arrived at and then switch 314 is turned off. In this fashion, only $I_{peak}$ is measured thereby causing a trip point while $I_{valley}$ is dependent on the predetermined delay built into controller 316. Peak current controller 316 has a delay associated with responding to current changes and thus the current going through the N series of LEDs 308 will exceed or overshoot the upper current threshold due to variations in line voltage 302. As described herein, controller 318 compensates for the power line variations.

Analog filtering and scaling system 326 receives line voltage 302 and provides an analog signal to threshold control 318 which has noise removed and components of interest isolated. It is further appreciated that in other embodiments line voltage signal 120 may be scaled or analog filtered.

Threshold control 318 receives the analog filtered and scaled signal and based on that signal generates modified/compensated controller thresholds (e.g., inversed value, threshold scaling factor, or a counteracting function) for peak current controller 316. Threshold control 318 then applies compensated thresholds to peak current controller 316 to substantially maintain the average current flowing through N series of LEDs 308 by dynamically altering the trip point at the overshoot side, e.g., $I_{peak}$.

FIG. 3*b* shows block diagram of another exemplary system for compensating for power line variation, in accordance with another embodiment of the present invention. System 350 includes a node for receiving line voltage ($V_{in}$) 302, sense resistor 304, N series of light emitting diodes (LEDs) 308, inductor 310, diode 312, switch 314, ground 311, peak current controller 316, threshold control 318, and controlled gain 320, analog to digital converter (ADC) 322, and filtering and scaling module 324.

System 350 operates in a substantially similar matter to system 300 except circuit 318 receives digital control signals. Filtering and scaling system 324 removes noise from line voltage 320. Filtering and scaling system 324 may further separate certain components (e.g., ripples in line voltage 302) and isolate components of interest. For example, filtering and scaling system 324 may isolate and respond to only certain frequencies which are of interest (e.g., ripples and variations below 120 Hz). Filtering and scaling system 324 thus removes noise and other variations in line voltage 302 thereby enabling system 350 to respond appropriately to variations in line voltage 302. It is appreciated that filtering and scaling system 324 may be optional and may facilitate increasingly precise control. It is further appreciated that in other embodiments line voltage signal 120 may be scaled or digitally filtered.

Analog to digital converter (ADC) 322 digitally samples a power source signal or line voltage 302. ADC 322 outputs the digital value to controlled gain 320. It is appreciated that ADC may be coupled to line voltage 320.

Controlled gain module 320 determines a compensation for a power variation in line voltage 302 and provides the compensation to threshold control 118. The compensation determined by controlled gain module 320 is used to adjust the threshold. In one embodiment, controlled gain module 320 may take a line voltage value perform an inversion and determine a factor for the threshold to be multiplied by to compensate for the variation in line voltage 302. The compensation may be determined based on a variety of techniques including, but not limited to, polynomials, lookup tables, which be in firmware or software. The threshold adjustment dynamically alters the trip point at the overshoot, e.g., $I_{peak}$.

Figure 4A:
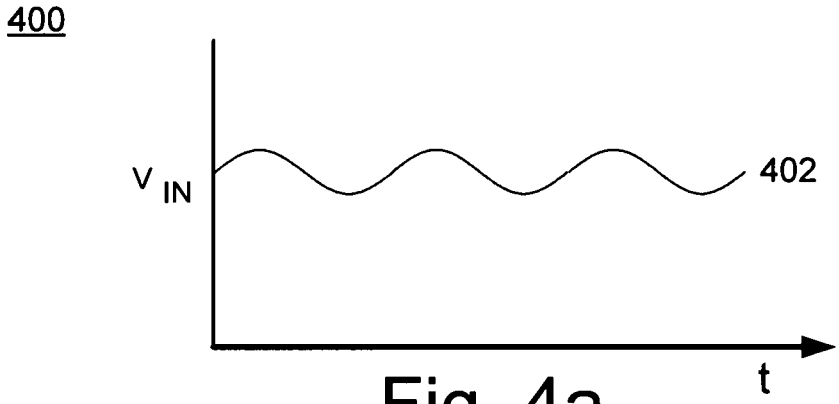
FIG. 4*a* shows an exemplary low frequency power line voltage variation over time.

FIG. 4*a* shows an exemplary low frequency line voltage ($V_{in}$) 402 (e.g., line voltage 102) variation over time. Graph 400 includes a vertical axis corresponding to the line voltage value and horizontal axis corresponding to the time. Line voltage 402 illustrates a low frequency sine wave like variation in a line voltage or power supply. It is appreciated that embodiments of the present invention may compensate for a variety of variations in line voltage 402 including, but not limited to, periodic variations (e.g., sine waves), ripples, spikes, as well as non-periodic variations.

Figure 4B:
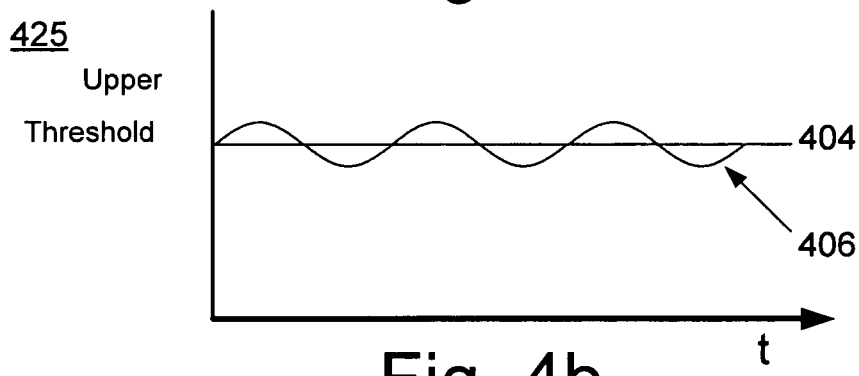
FIG. 4*b* shows an exemplary upper threshold and current variation over time.

FIG. 4*b* shows an exemplary upper threshold, corresponding to $I_{peak}$, and current variation over time caused by line voltage variation. Graph 425 includes a vertical axis corresponding to the current (e.g., through N series of LEDs 108) and horizontal axis corresponding to the time. Line 404 corresponds to an ideal current threshold. Line 406 corresponds to the actual current in response to variations line voltage 402 as a controller (e.g., current controller 116 or peak current controller 316) responds to the power variations of line voltage 402.

Figure 4C:
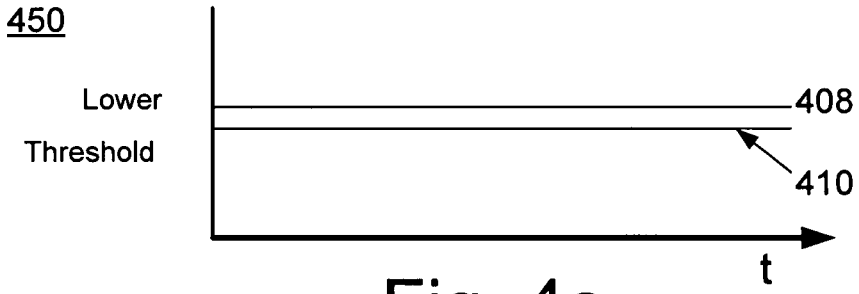
FIG. 4*c* shows an exemplary lower threshold and compensated threshold over time in accordance with embodiments of the present invention.

FIG. 4*c* shows an exemplary lower threshold and a current variation over time. Graph 450 includes a vertical axis corresponding to the current (e.g., through N series of LEDs 308) and horizontal axis corresponding to the time. Line 410 corresponds to an ideal threshold (e.g., for a controller without a delay). Line 408 corresponds to a compensated threshold for a controller (e.g., current controller 116 or peak current controller 316). It is appreciated that compensated threshold 408 may be higher than the ideal threshold so that during undershoot the current reaches ideal threshold 410. Since the inductor is supplying the voltage when the switch is off, power line variations are not present in FIG. 4*c*.

Figure 4D:
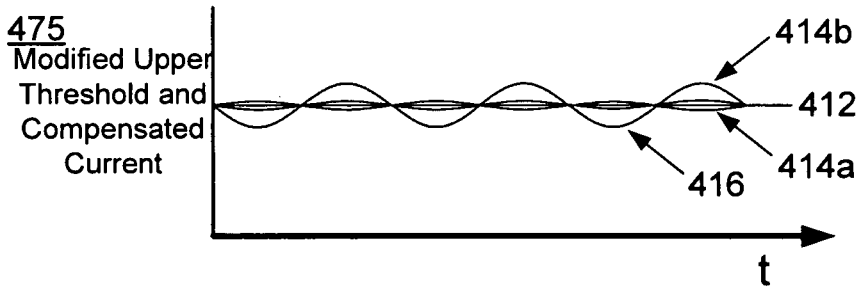
FIG. 4*d* shows an exemplary compensated current variation and adjusted threshold over time, in accordance with one embodiment of the present invention.

FIG. 4*d* shows an exemplary modified upper threshold and compensated current over time, in accordance with one embodiment of the present invention. Graph 475 includes a vertical axis corresponding to the current and horizontal axis corresponding to the time. Line 412 corresponds the ideal average current flowing through an LED (e.g., N series of LEDs 108). Line 416 is an inversion of the power line ripple and therefore corresponds to the compensated thresholds of the controller (e.g., current controller 116 or peak current controller 316). It is noted that line 416 corresponds to modified thresholds that substantially cancel out the effects of variations in line voltage (e.g., line 402) in accordance with embodiments of the present invention.

Lines 414*a* and 414*b* correspond to the envelope of the possible values of actual current based on modified thresholds received by the controller in accordance with embodiments of present invention. It is appreciated that substantial portions of variations in the line voltage (e.g., line 402) have been cancelled out. In one embodiment, variations may be caused by spread of the delay of controller. For example, if the delay is a priori determined to be 100 nanoseconds (ns) but the delay of the controller varies from 110 ns to 90 ns, the thresholds of the threshold can be varied to compensate but there may be some residual variations.

Example Operations

Figure 5:
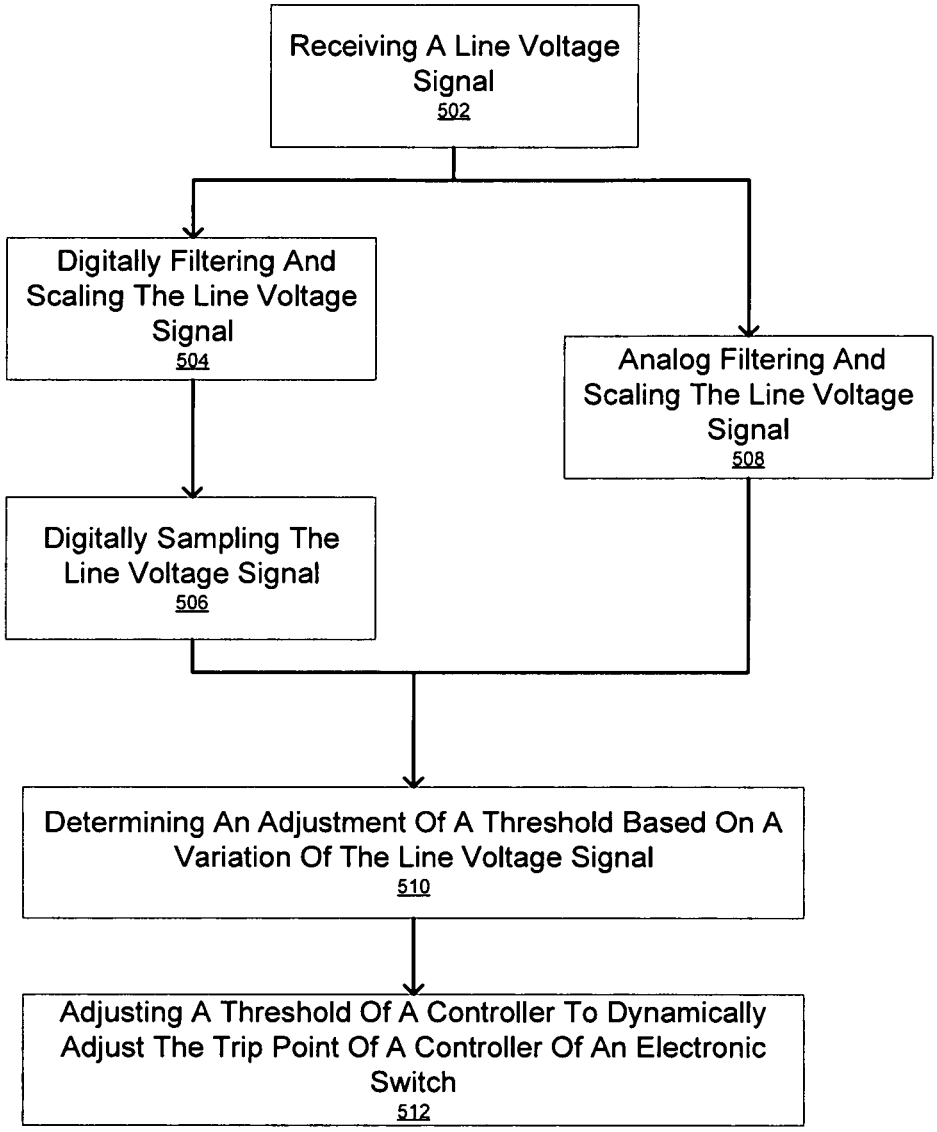
FIG. 5 shows a flowchart of an exemplary method for controlling light emitting diode (LED) output, in accordance with an embodiment of the present invention.

With reference to FIG. 5, exemplary flowchart 500 illustrates example blocks used by various embodiments of the present invention. Although specific blocks are disclosed in flowchart 500, such blocks are examples. That is, embodiments are well suited to performing various other blocks or variations of the blocks recited in flowchart 500. It is appreciated that the blocks in flowchart 500 may be performed in an order different than presented, and that not all of the blocks in flowchart 500 may be performed. Flowchart 500 includes processes that, in various embodiments, are carried out by a processor under the control of computer-readable and computer-executable instructions. Embodiments of the present invention may thus be stored as computer readable media or computer-executable instructions including, but not limited to, a firmware update, software update package, or hardware (e.g., ROM).

In particular, FIG. 5 shows a flowchart of an exemplary process for controlling light emitting diode (LED) output, in accordance with an embodiment of the present invention. Blocks of flow chart 500 may be carried out by modules of system (e.g., systems 100, 200, 300, and 350) for controlling an LED circuit.

At block 502, a line voltage signal (e.g., line voltage 102 or 302) is sampled. As described herein, the line voltage may be from a rectifier and power a lighting circuit comprising an LED (e.g., N series of LEDs 108).

At block 504, the line voltage signal may be digitally filtered and scaled. As described herein, the line voltage signal may be filtered to have noise remove and components of interest isolated (e.g., frequencies less than 120 Hz). It is appreciated that in other embodiments the line voltage signal may be scaled or digitally filtered.

At block 506, the line voltage signal is digitally sampled. As described herein, the line voltage may be digitally sampled by an analog to digital converter (ADC) (e.g., ADC 122).

At block 508, the line voltage signal is processed via analog filtering and scaling. As described herein, the line voltage signal may be processed to remove noise and isolate components of interest in an analog manner. It is appreciated that in other embodiments the line voltage signal may be scaled or analog filtered.

At block 510, an adjustment of a threshold is determined based on a variation of the line voltage signal. As described herein, an adjustment of a threshold may be computed via an inverse or a counteracting function of the measured variation and a scaling factor (e.g., via controlled gain 120).

At block 512, a threshold of a controller that controls the switch is dynamically adjusted. The controller may control a switch of a lighting circuit. As described herein, the threshold may be determined based on the adjustment and the threshold of the controller (e.g., a switch mode controller with a threshold inherent to its operation including, but not limited to, hysteric controller 116 or peak current controller 316) to cancel out (e.g., remove impact of an overshoot of a threshold) the effects of variations of the line voltage signal. The power supply ripple or variation rejection is thereby improved and the effect of the line ripple is removed from the current to the LED. It is appreciated that Block 502 may then be performed if multiple compensations are to be made. For example, if 70% of a line voltage signal can be compensated out then block 502 may be performed as part of a second order compensation.

Thus, embodiments of the present invention may provide a compensation system to reduce or eliminate the impact of line voltages variations and controller delays on current supplied to an LED light source in an LED circuit. The compensation system derives a threshold based on the line voltage variation such that effect of the line voltage variation and controller delay is substantially cancelled out in an embodiment. Embodiments of the present invention further allow use of simplified front end DC-DC converters to supply LED driver stages because embodiments can tolerate increased line voltage variations. The simplification of front end DC-DC converters combined with an LED driver circuit in accordance with embodiments of the present invention may thus reduce cost. Moreover, embodiments of the present invention may be implemented in a power programmable system on a chip (SoC).

Embodiments of the present invention are thus described. While the present invention has been described in particular embodiments, it should be appreciated that the present invention should not be construed as limited by such embodiments, but rather construed according to the below claims.

What is claimed is:

1. A method for powering a light emitting diode (LED), the method comprising:

processing a line voltage powering a lighting circuit comprising said LED, wherein said processing comprises filtering said line voltage to isolate a variation of the line voltage recurring at or below a predetermined frequency;

determining an adjustment value for a current threshold of a controller of said lighting circuit based on the variation of the line voltage, wherein said controller is a hysteretic controller and determining the adjustment value comprises determining a counteracting function of said measured variation and a scaling factor;

adjusting said current threshold of said controller of said lighting circuit, using the determined adjustment value, wherein said controller is configured to trip a switch of said lighting circuit, when the adjusted current threshold is met.

2. The method of claim 1, wherein said controller includes a switch mode controller, wherein the current threshold is inherent to an operation of said switch mode controller.

3. The method of claim 1, wherein said controller includes a linear mode current controller.

4. The method of claim 1, wherein said processing comprises analog filtering and scaling.

5. The method of claim 1, wherein said processing comprises digitally sampling said line voltage.

6. The method of claim 1, wherein said predetermined frequency is 120 Hz.

7. A system to compensate for power line variations, the system comprising: a first stage power supply configured to supply a first current; a second stage power supply operating from the first stage power supply and configured to convert the first current to a second current, the second current being a direct current; a line voltage node receiving the second current; and a circuit including: a filtering and scaling circuit in operable communication with the line voltage node for filtering the line voltage to detect a frequency ripple at or below a predetermined frequency on the second current received by the line voltage node, a controller operable to control a switch and determine a third current of a circuit comprising a light emitting diode (LED); a controlled gain module to dynamically determine, based on the detected frequency ripple and a scaling factor, a compensation value for a power line variation including the detected frequency ripple; and a threshold control module configured to use said compensation value to dynamically modify a current threshold of said controller, wherein the controller is a hysteretic controller and uses the modified current threshold to compensate for said power line variation with respect to said third current of said circuit comprising said LED.

8. The system of claim 7, wherein said controller is a switch mode controller, wherein the current threshold is inherent to an operation of said switch mode controller.

9. The system of claim 7, wherein said filtering and scaling circuit is an analog filtering and scaling circuit.

10. The system of claim 7, further comprising an analog to digital converter coupled to said controlled gain module and to digitally sample a power source signal.

11. The system of claim 7, wherein said compensation value for said power line variation comprises an inverse of said power line variation.

12. A non-transitory computer readable media comprising instructions that when executed by a processor implement a method of compensating for power line variations, said method comprising: sampling a line voltage receiving direct current (DC) power, wherein said line voltage powers a lighting circuit comprising a light emitting diode (LED) and includes a variation ripple, wherein said sampling comprises filtering said line voltage to detect a variation ripple at or below a predetermined frequency; determining an adjustment value to be applied to an upper current threshold of a controller of said lighting circuit wherein said controller is a hysteretic controller and wherein said determining the adjustment value comprises determining an inverse of said detected variation ripple and a scaling factor; and adjusting said upper current threshold of said controller, using the determined adjustment value, wherein said controller controls a switch of said lighting circuit which controls current through said LED.

13. The non-transitory computer readable media of claim 12, wherein said controller includes a peak current controller.

14. The non-transitory computer readable media of claim 12, wherein said filtering and scaling comprises analog filtering and scaling.

15. The non-transitory computer readable media of claim 12, wherein said sampling comprises digitally sampling said line voltage.

16. The non-transitory computer readable media of claim 12, wherein said method further comprises upon detecting a variation ripple at or below the predetermined frequency adjusting a lower current threshold of said controller based on a delay of said controller and independent of said line voltage.

17. The non-transitory computer readable media of claim 12, wherein said predetermined frequency is 120 Hz.

* * * * *